US010266243B2

(12) United States Patent
Palanisamy

(10) Patent No.: US 10,266,243 B2
(45) Date of Patent: Apr. 23, 2019

(54) FLOATATION DEVICE WITHOUT PRESSURIZED CONTAINER

(71) Applicant: Goodrich Corporation, Charlotte, NC (US)

(72) Inventor: Jai Ganesh Palanisamy, Bangalore (IN)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 15/644,366

(22) Filed: Jul. 7, 2017

(65) Prior Publication Data

US 2018/0273150 A1 Sep. 27, 2018

(30) Foreign Application Priority Data

Mar. 23, 2017 (IN) ..... 201711010271

(51) Int. Cl.

| | |
|---|---|
| ***B63C 9/18*** | (2006.01) |
| ***B63C 9/08*** | (2006.01) |
| ***B63B 22/22*** | (2006.01) |
| *B63C 9/00* | (2006.01) |

(52) U.S. Cl.

CPC ..... *B63C 9/18* (2013.01); *B63B 22/22* (2013.01); *B63C 9/081* (2013.01); *B63C 2009/0035* (2013.01)

(58) Field of Classification Search

CPC . B63C 9/18; B63C 2009/0035; A47C 27/084; A47C 27/08; A47C 27/18; A47C 27/20; A63H 3/06

USPC ..... 5/708

See application file for complete search history.

(56) References Cited

U.S. PATENT DOCUMENTS

| | | | | |
|---|---|---|---|---|
| 205,617 A | | 7/1878 | D'Alessandro | |
| 3,339,218 A | | 9/1967 | Stamberger | |
| 3,378,864 A | | 4/1968 | Cornes | |
| 3,447,175 A | * | 6/1969 | Sullivan | B63C 9/1255 441/118 |
| 3,643,268 A | * | 2/1972 | Stamberger | A47C 27/084 206/0.6 |

(Continued)

FOREIGN PATENT DOCUMENTS

| | | |
|---|---|---|
| DE | 58889 | 6/1890 |
| DE | 4034593 A1 | 7/1990 |

(Continued)

OTHER PUBLICATIONS

Extended European Search Report for Application No. 18163159.9-1015, dated Jul. 19, 2018 (8 pp.).

*Primary Examiner* — Anthony D Wiest
(74) *Attorney, Agent, or Firm* — Cantor Colburn LLP

(57) ABSTRACT

A floatation device includes a body transformable between a retracted configuration and an extended configuration. A stiffener assembly is movable between a first position and a second position. The stiffener assembly is biased into the second position. The stiffener assembly is operably coupled to the body such that movement of the stiffener assembly between the first position and the second position causes the body to transform between the retracted position and the extended position. During the transformation of the body between the retracted position and the extended position, a partial vacuum is created within the body to inflate the floatation device.

19 Claims, 14 Drawing Sheets

(56) References Cited

U.S. PATENT DOCUMENTS

| | | | | |
|---|---|---|---|---|
| 4,521,166 | A * | 6/1985 | Phillips | A47C 27/084 417/478 |
| 8,016,627 | B2 | 9/2011 | Andrea et al. | |
| 8,408,959 | B2 * | 4/2013 | Wickham | B63C 9/082 441/84 |
| 2004/0222684 | A1 * | 11/2004 | VanSickle | A47C 4/54 297/452.41 |
| 2006/0037145 | A1 * | 2/2006 | Wang | A47C 27/084 5/709 |
| 2006/0040803 | A1 * | 2/2006 | Perez, Jr. | A47C 7/425 482/112 |
| 2006/0270290 | A1 | 11/2006 | Tellew | |
| 2008/0047072 | A1 * | 2/2008 | Chang | A47C 27/081 5/708 |
| 2011/0089741 | A1 * | 4/2011 | Cyr | A47C 4/54 297/452.41 |

FOREIGN PATENT DOCUMENTS

| | | | |
|---|---|---|---|
| WO | 85/02156 | A1 | 3/1985 |
| WO | 2005/049384 | A1 | 6/2005 |

* cited by examiner

Section view B-B

Section view A-A (Valve Positions when Pull knob Released by Trigger Pin)

Section view A-A
(Valve Positions when Plunger is pulled-out for pumping additional Air)

FLOATATION DEVICE WITHOUT PRESSURIZED CONTAINER

CROSS REFERENCE TO RELATED APPLICATIONS

This application claims the benefit of Indian Application No.: 201711010271, filed Mar. 23, 2017, which is incorporated herein by reference in its entirety.

BACKGROUND

Exemplary embodiments pertain generally to emergency floatation devices adapted to assist in the rescue of persons from a body of water. More particularly, the disclosure related to emergency floatation devices that are configured to automatically inflate without the use of a pressurized cylinder.

Several thousand people drown worldwide each year. In many instances, these deaths are the result of exhaustion, dehydration, and hypothermia induced loss of coordination and consciousness. Throwable floatation devices are commonly used in rescue operations where a victim is drowning or stranded within a body of water. The floatation device is intended to safely support the victim until a more permanent rescue operation can be effectuated.

These floatation devices, commonly used by the Navy and Coast Guard, typically include a pressurized container configured to automatically inflate the device. However, inclusion of one or more pressurized containers not only adds weight to the floatation device, but also requires that the containers be refilled before being reused. Further, in certain conditions, the fabrics used are no 100% leak proof. As a result, the float pressure and therefore the buoyancy of the float will gradually reduce. Due to their fixed nature, alternative floatation devices, such as ring buoys and cushions, require more space when stored.

BRIEF DESCRIPTION

According to an embodiment, a floatation device includes a body transformable between a retracted configuration and an extended configuration. A stiffener assembly is movable between a first position and a second position. The stiffener assembly is biased into the second position. The stiffener assembly is operably coupled to the body such that movement of the stiffener assembly between the first position and the second position causes the body to transform between the retracted position and the extended position. During the transformation of the body between the retracted position and the extended position, a partial vacuum is created within the body to inflate the floatation device.

In addition to one or more of the features described above, or as an alternative, in further embodiments comprising a mechanism for manually inflating the body when the body is in the extended configuration.

In addition to one or more of the features described above, or as an alternative, in further embodiments the mechanism is operable to inflate the body to a pressure substantially equal to an ambient atmospheric pressure.

In addition to one or more of the features described above, or as an alternative, in further embodiments the mechanism is operable to pump air into the body.

In addition to one or more of the features described above, or as an alternative, in further embodiments the stiffener assembly includes: a pair of first members operably coupled together by a pair of first structural connectors and a pair of second members operably coupled together by a pair of second structural connectors, each second member being disposed in overlapping arrangement with one of the pair of first members, the second members being rotatable relative to the first members.

In addition to one or more of the features described above, or as an alternative, in further embodiments in the first position, the pair of first structural connectors and the pair of second structural connectors are substantially parallel.

In addition to one or more of the features described above, or as an alternative, in further embodiments in the second position, the pair of second structural connectors is at an angle relative to the first structural connectors.

In addition to one or more of the features described above, or as an alternative, in further embodiments the angle is between about 60 degrees and about 120 degrees.

In addition to one or more of the features described above, or as an alternative, in further embodiments the pair of first structural connectors and the pair of second structural connectors are formed from a resilient material.

In addition to one or more of the features described above, or as an alternative, in further embodiments the body includes a skin configured to define an interior cavity. The stiffener assembly is operably coupled to the skin. The floatation device further comprises a valve assembly arranged in fluid communication with the interior cavity, the valve assembly being coupled to the stiffener assembly.

In addition to one or more of the features described above, or as an alternative, in further embodiments movement of the stiffener assembly to the second position causes at least one valve of the valve assembly to seal and block a flow into and out of the interior cavity.

In addition to one or more of the features described above, or as an alternative, in further embodiments the valve assembly comprises at least a first valve and a second valve operably coupled to one another, the first valve and the second valve being movable to selectively control a flow into and out of the interior cavity.

In addition to one or more of the features described above, or as an alternative, in further embodiments a patch is mounted at at least one interface between the skin and the stiffener assembly.

According to another embodiment, a method of inflating a floatation device includes biasing a stiffener assembly from a first position to a second position such that the floatation device transitions from a retracted position to an extended position, creating a partial vacuum within an interior cavity of the floatation device causing air to be drawn therein, and sealing at least one valve of a valve assembly of the floatation device to block a flow of air into and out of the interior cavity.

In addition to one or more of the features described above, or as an alternative, in further embodiments comprising removing the floatation device from a storage container.

In addition to one or more of the features described above, or as an alternative, in further embodiments comprising manually inflating the floatation device when in the extended configuration.

In addition to one or more of the features described above, or as an alternative, in further embodiments manually inflating the floatation device includes opening at least one valve of the valve assembly to allow air to flow into the interior cavity.

In addition to one or more of the features described above, or as an alternative, in further embodiments manually inflating the floatation device includes equalizing a pressure within the interior cavity with an ambient atmospheric pressure.

In addition to one or more of the features described above, or as an alternative, in further embodiments manually inflating the floatation device includes repeatedly translating a plunger of the valve assembly to form a pumping mechanism.

In addition to one or more of the features described above, or as an alternative, in further embodiments translation of the plunger away from the valve assembly creates a vacuum and translation of the plunger towards the valves assembly causes at least one valve of the valve assembly to open and the air within the valve assembly to flow into the interior cavity.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
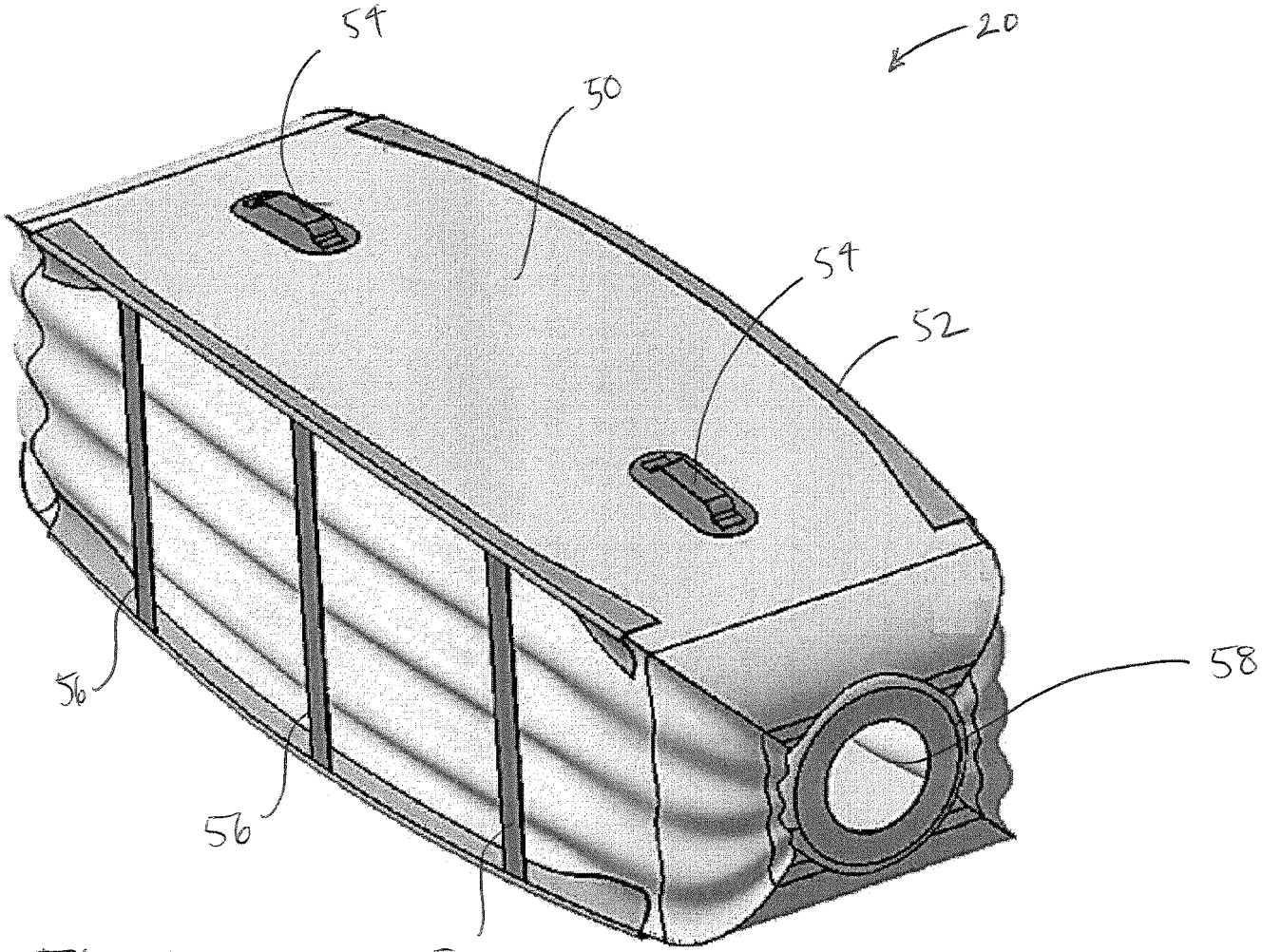
FIG. 1 is perspective view of a portion of a floatation device according to an embodiment.
Figure 2:
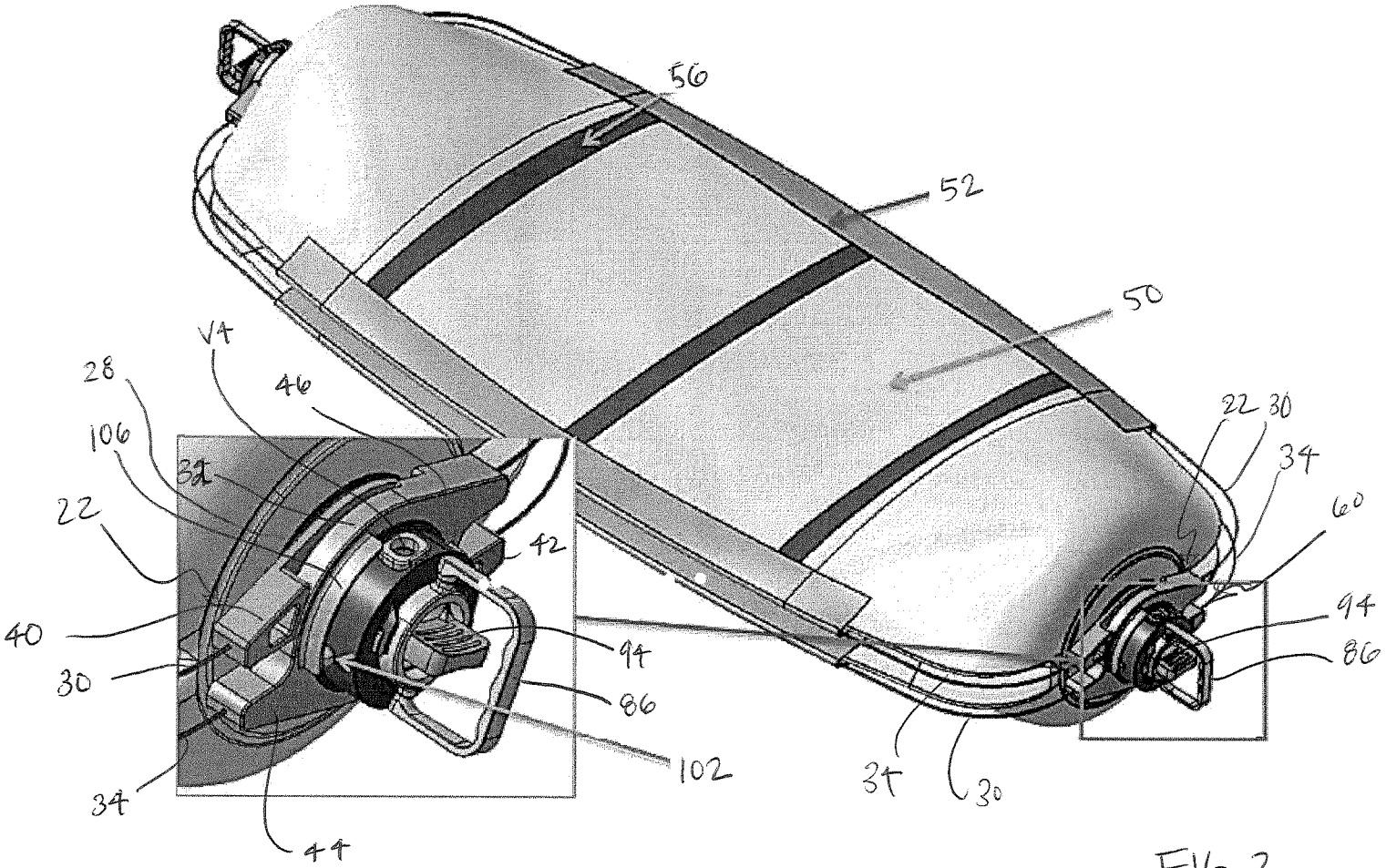
FIG. 2 is a perspective view of a floatation device in a retracted configuration according to an embodiment.
Figure 3:
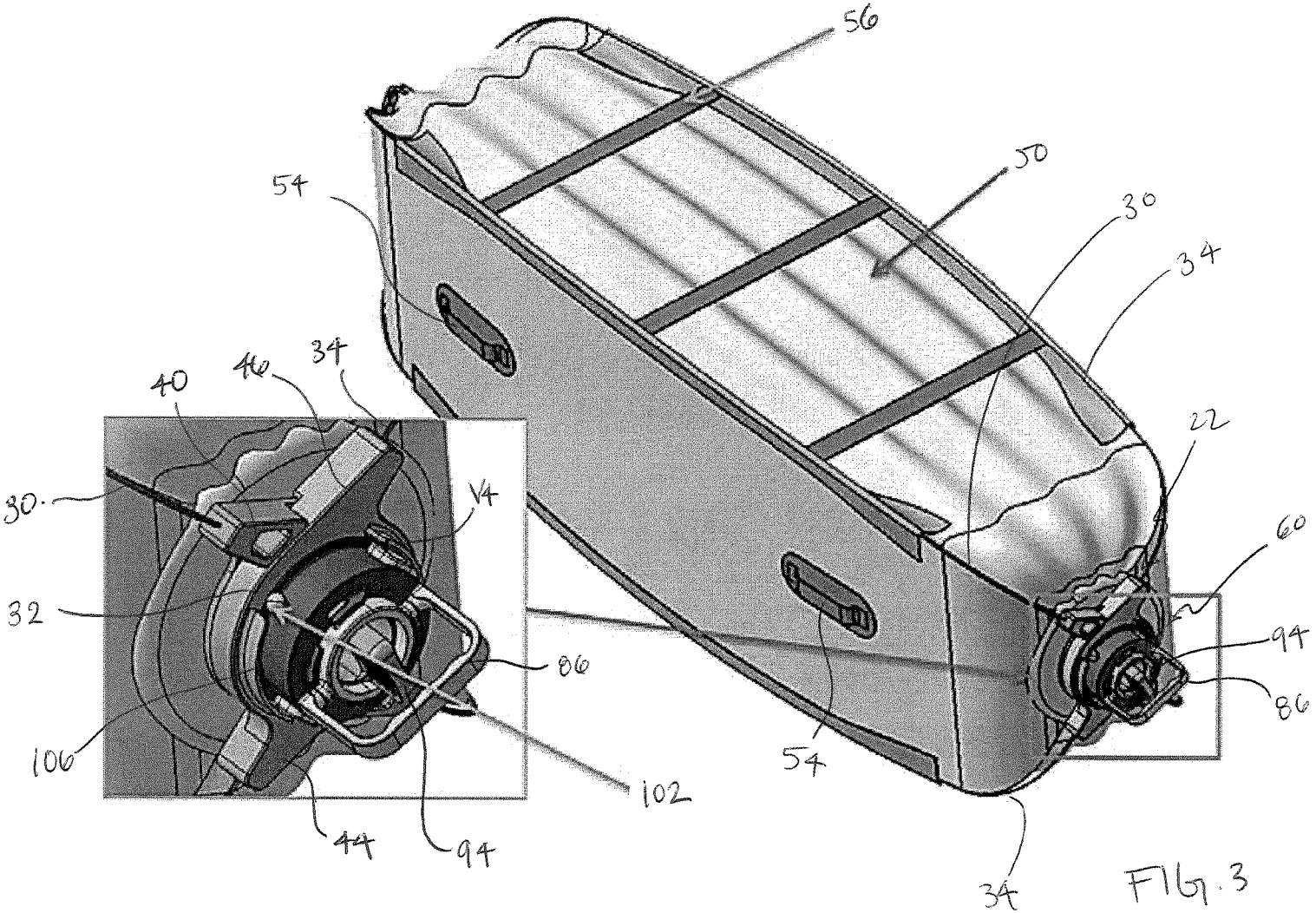
FIG. 3 is a perspective view of a floatation device in an extended configuration according to an embodiment.

Referring now to the FIGS. 1-3, an example of a floatation device or float 20 is illustrated. The floatation device 20 is configured to transform between a first, retracted configuration (FIG. 2) and a second, extended configuration (FIGS. 1 and 3). In the retracted configuration, the floatation device 20 may be generally flattened and folded for storage, such as within a container for example. In the extended configuration, the floatation device 20 is generally filled with air or another gas to achieve a sufficient level of buoyancy required for an application. A stiffener assembly 22 is operable to automatically transform the floatation device 20 from the retracted configuration to the extended configuration.

An example of the stiffener assembly 22 is illustrated in more detail in FIGS. 4 and 5. The stiffener assembly 22 includes a first stiffener 24 and a second stiffener 26 configured to cooperate with one another in a manner similar to a scissor mechanism to transition between a first configuration and a second configuration. The first stiffener 24 includes at least one first member 28. In the illustrated, non-limiting embodiment, the stiffener assembly 22 includes a pair of substantially identical first members 28 arranged generally parallel and offset from one another and in vertical alignment. In such embodiments, the pair of first members 28 are rotated 180 degrees relative to one another such that a first surface of the first members 28 face towards one another. A pair of substantially identical first structural connectors 30 extend between and connect a first side of the pair of first members 28 and a second side of the pair of first members 28, respectively.

The second stiffener 26 similarly includes at least one second member 32. In an embodiment, the at least one second member 32 includes a pair of substantially identical second members 32 arranged parallel to and offset from one another in vertical alignment. The pair of second members 32 may additionally be rotated 180 degrees relative to one another. Further, a pair of substantially identical second structural connectors 34 extends between and connect a first side of the pair of second members 32 and a second side of the pair of second members 32, respectively. The first structural connectors 30 of the first stiffener 24 and the second structural connectors 34 of the second stiffener 26 may, but need not be substantially identical to one another. In an embodiment, the first and second structural connectors 30, 34 are formed from a thin, strong, and resilient material, such as steel for example.

Each of the first members 28 includes a first arm 40 and a second arm 42 extending therefrom. Similarly, each of the second members 32 has a first arm 44 and a second arm 46 extending therefrom. The at least one second member 32 is arranged in overlapping arrangement with the at least one first member 28. For example, the second member 32 may have a contour complementary to and configured to receive a flange extending from the first member 28.

The at least one second member 32 is configured to rotate relative to the first members 28 between a first configuration and a second configuration. In an embodiment, a torsion spring 48 (see FIG. 4B) is positioned at the interface between a first member 28 and a corresponding second member 32. The torsion spring is configured to bias the stiffener assembly into the second configuration.

Figure 5A:
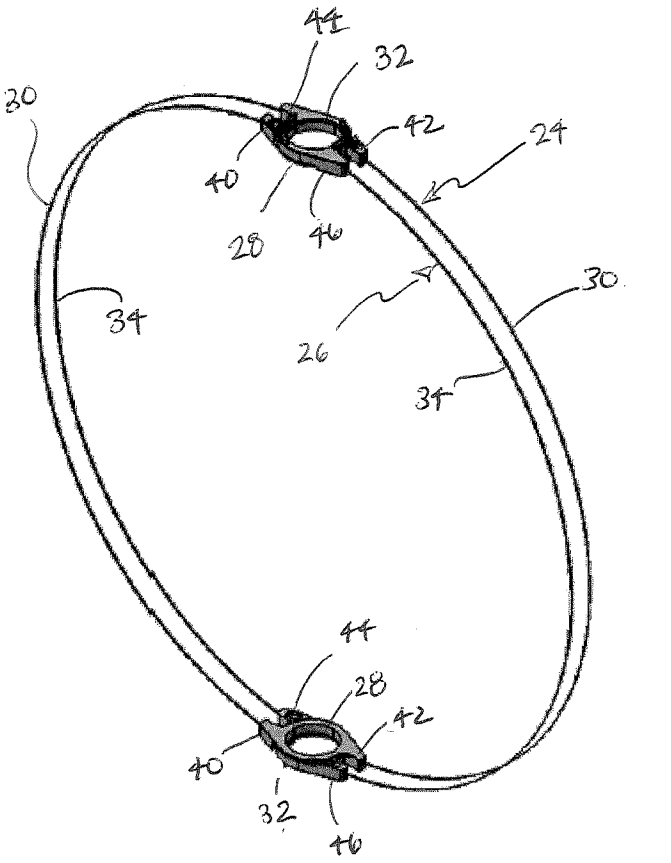
FIGS. 5A and 5B are perspective view of a stiffener assembly in a first and second configuration according to an embodiment.
Figure 4A:
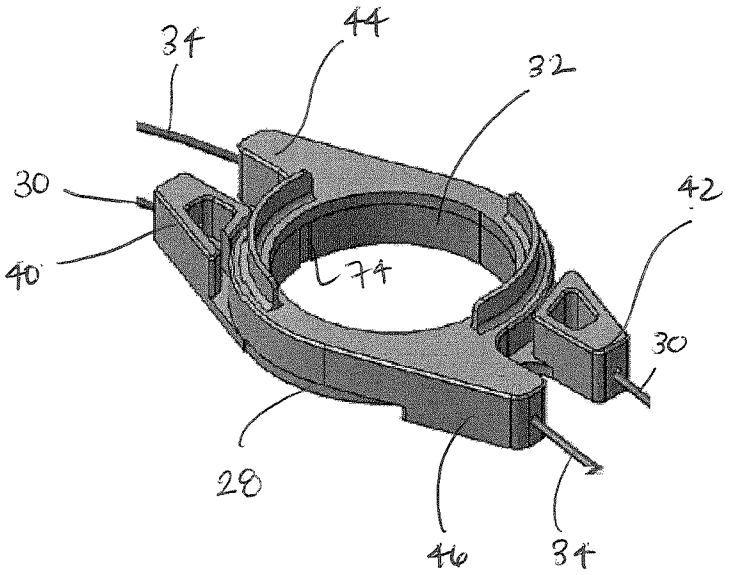
FIGS. 4A and 4B are perspective views of a portion of stiffener assembly according to an embodiment.
Figure 5B:
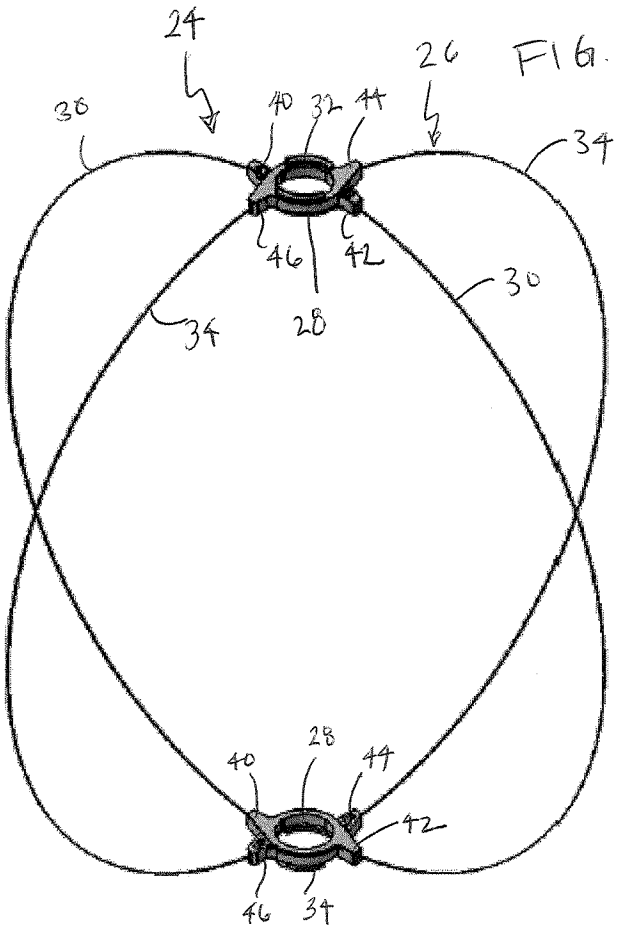

In the first configuration, shown in FIGS. 4A and 5A, the first arm 40 of the first member 28 is positioned generally adjacent the first arm 44 of the second member 32 and the second arm 42 of the first member 28 is positioned generally adjacent the second arm 46 of the second member 32 such that the first structural connectors 30 and the second structural connectors 34 are generally parallel. However, the spring or biasing force of the structural connectors is configured to bias the assembly to a second configuration, illustrated in FIGS. 4B and 5B. As shown, in the second configuration, the second arm 46 of the second member 32 is arranged generally adjacent the first arm 40 of the first member 28, and the first arm 44 of the second member 32 is arranged generally adjacent the second arm 42 of the first member 28. Accordingly, in this second, rotated configuration, the second structural connectors 34 are arranged at an angle to the first structural connectors 30. In an embodiment, the angle formed between the second structural connectors 34 and the first structural connectors 30 is between about 60 degrees and about 120 degrees, such as about 90 degrees for example.

With reference again to FIGS. 1-3, a skin 50 is connected to the stiffener assembly 22. Accordingly, movement of the stiffener assembly 22 between the first configuration and the second configuration causes the floatation device 20 to transition between the retracted position and the extended position, respectively. The skin 50 is shaped to define an interior cavity capable of being filled with air when the float 20 is extended and releasing air to retract the float 20.

The skin 50 may be formed from any suitable air tight material, such as is used in other known inflatable floatation devices for use in water safety rescue applications. In an embodiment, as best shown in FIG. 2, the structural connectors 30, 34 of the stiffener assembly 22 are arranged about an exterior of the skin 50. However, it should be understood that embodiments where the skin 50 wraps about an exterior of the structural connectors 30, 34 is also contemplated herein. The structural connectors 30, 34 may be coated with a protective coating to prevent the material of the skin 50 from being damaged or the structural connectors 30, 34 from corrosion due to exposure to moisture or high salt environments.

In an embodiment, patches 52 are used to provide reinforcement at the interface between the skin 50 and a corresponding structural connector 30, 34. The patches 52 may be adhered to the surface of the skin 50, or alternatively, may be mechanically fastened thereto. In an embodiment, one or more handles or grips 54 is mounted to the exterior of the skin. The handle 54 is intended to allow a user to easy grasp and maneuver the floatation device when deployed.

When the floatation device 20 is in a retracted position, the length of the skin 50 extending between the structural connector 30, coupling the first arms 40 of the first members 28 and the structural connector 34 connected to the second arms 46 of the second member 32 is greater than the distance between those structural connectors 30, 34 when the floatation device 20 is extended. This difference is length will vary based on the angle between the structural members 30, 34 when the floatation device is extended. To facilitate the formation of folds or wrinkles to take up this extra length in the skin 50 when the float 20 is deployed, one or more elastic bands 56 extends across this elongated length between structural members 30, 34. The elastic bands 56 are sized such that when the floatation device 20 is in the retracted configuration, the elastic bands 56 are extended beyond normal length. Accordingly, the biasing or tension force of the elastic bands 56 urges the skin 50 towards the extended position.

Figure 6:
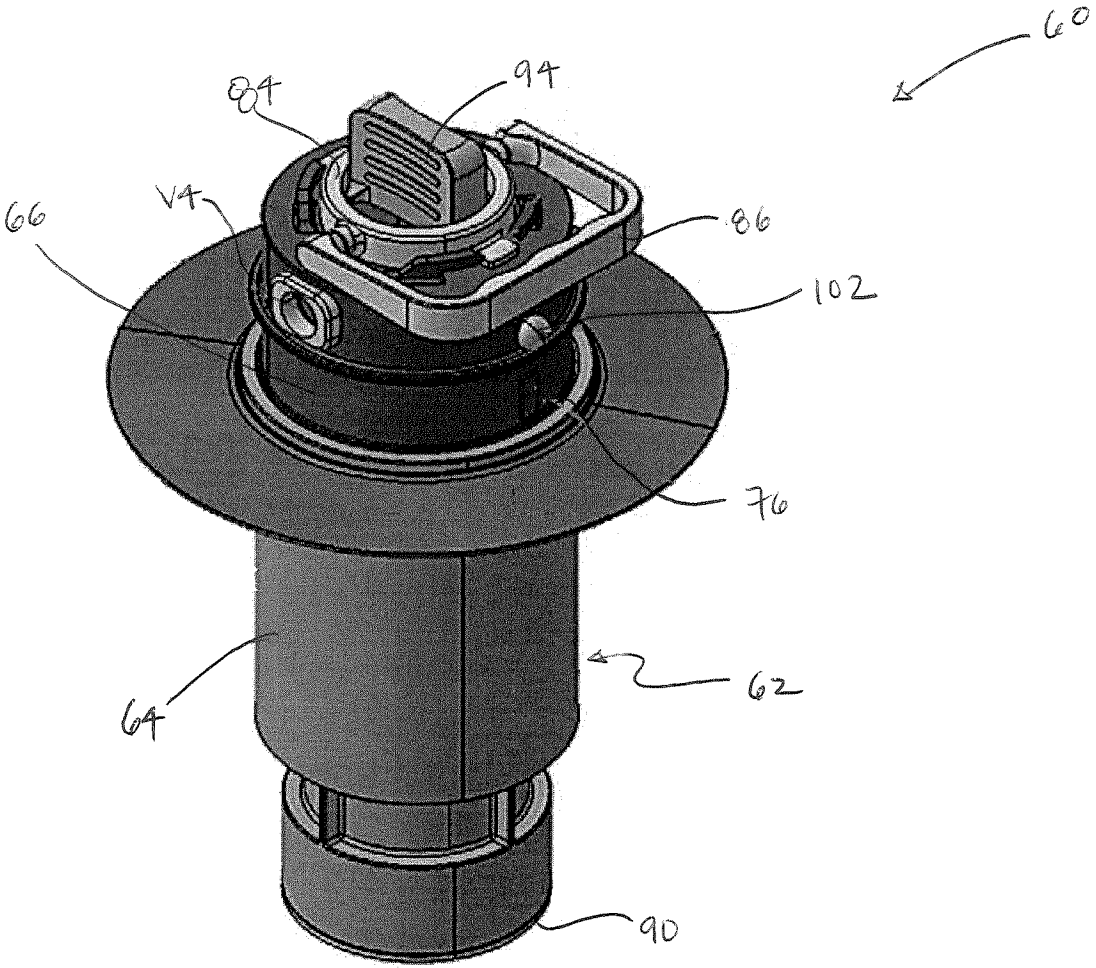
FIG. 6 is a perspective view of a valve assembly of the floatation device according to embodiment.
Figure 7:
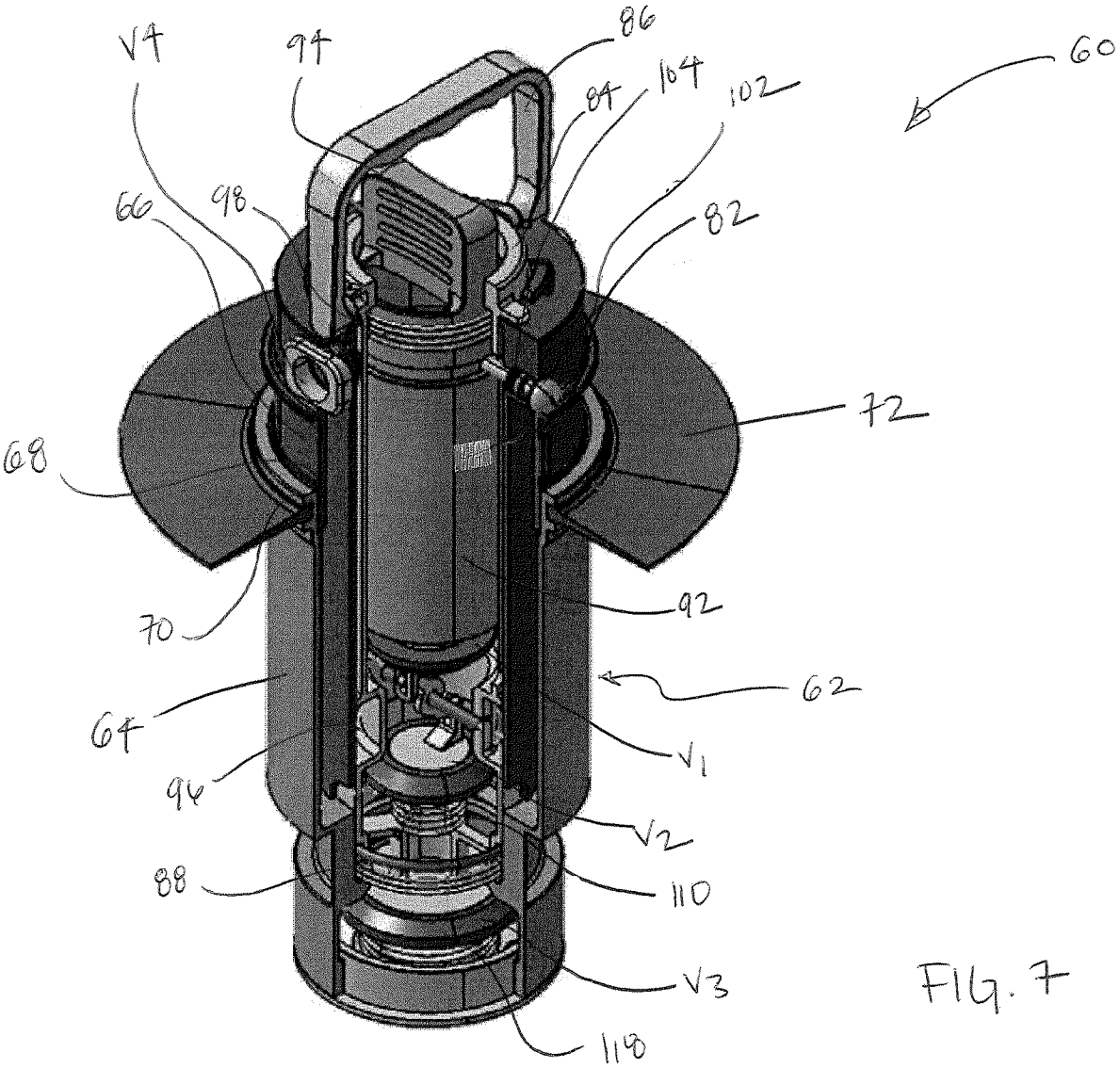
FIG. 7 is a partially cut away perspective view of a valve assembly of the floatation device according to embodiment.
Figure 8:
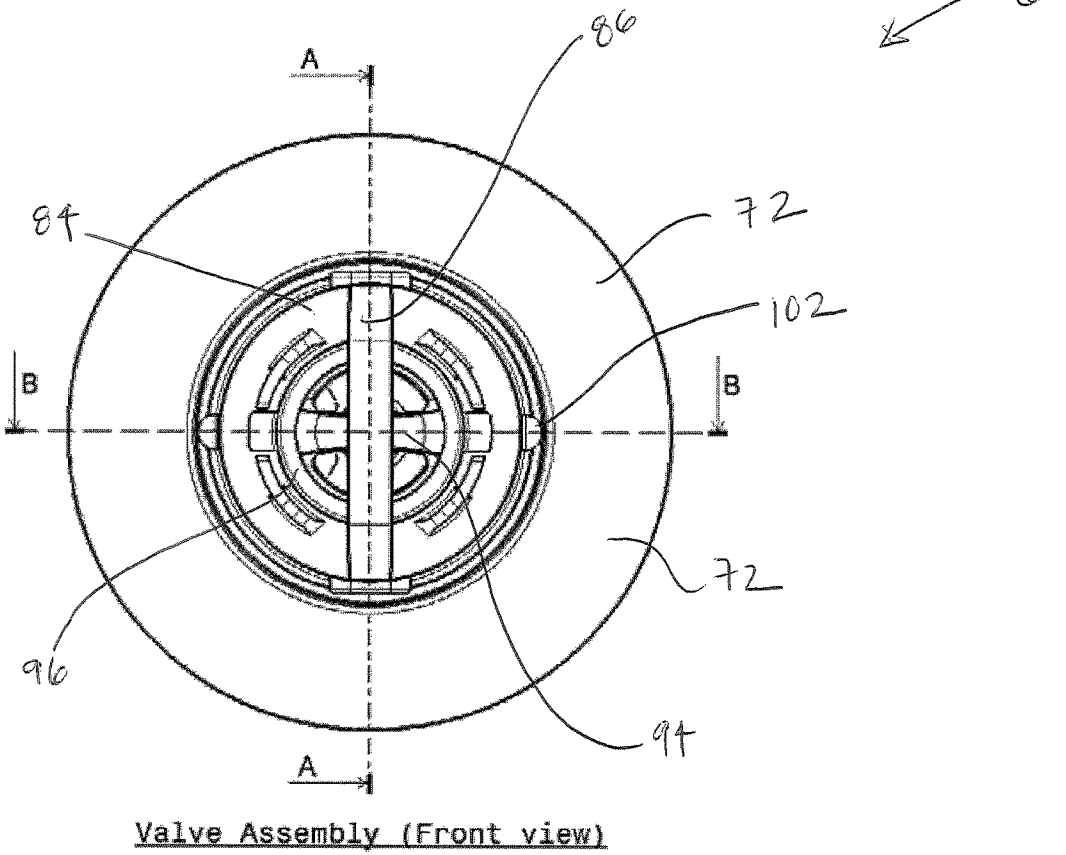
FIG. 8 is a plan view of a valve assembly of the floatation device according to an embodiment.

Referring now to FIGS. 6-8, the floatation device 20 additionally includes at least one valve assembly 60. A housing 62 of the valve assembly 60 may be formed from a lightweight, durable material, such as plastic for example. As shown, the housing 62 includes a complementary rear housing 64 and front housing 66. The rear housing 64 may be located within an opening 58 formed in the skin 50 of the floatation device 20, and the front housing 66 may extend beyond the exterior of the skin 50. In the illustrated, non-limiting embodiment, a first end 68 of the front housing 66 is receivable within the first end 70 of the rear housing 64 in an overlapping arrangement. However, a housing 62 having another configuration, such as where the first ends 68, 70 of the front and rear housing 64, 66 abut one another or where the front housing 66 and the rear housing 64 are integrally formed, are also contemplated herein. An outwardly extending sealing flange 72 may be mounted adjacent the first end 70 of the rear housing 64 to substantially seal the opening 58 in the skin 50 so that no fluid can flow between the exterior of the housing 62 and the interior of the opening 58.

The overlapping first member 28 and second member 32 of the stiffener assembly 22 are positioned about the exterior surface of the front housing 66. Accordingly, in embodiments including two pairs of first and second members 28, 32, a distinct valve assembly 60 may be located at opposing ends of the floatation device 20. In an embodiment, a groove or keyway 74 is formed in a portion of the first member 28 (see FIGS. 4A and 4B). When the first member 28 is coupled to the front housing 66, a flange or tooth 76 extending outwardly from the exterior of the front housing 66 is received within the keyway 74 to restrict rotation of the first member 28 relative to the valve assembly 60.

Together the front and rear housings 64, 66 cooperate to define a first, generally hollow chamber 78. A second chamber 80 formed in the rear housing 64 may be arranged in fluid communication with first chamber 78 and the interior cavity of the float 20. A plunger 82 is arranged within the interior of the housing 62 and extends between the first and second chambers 78, 80. A first end 84 of the plunger 82 extends beyond the front housing 66, outside the first chamber 78. In an embodiment, a handle 86 is mounted about the first end 84 of the plunger 82 for manipulation thereof. A biasing mechanism 88, such as a coil spring for example, is coupled to a second, opposite end 90 of the plunger 82 and is configured to bias the plunger 82 to a default position relative to the first chamber 78.

A cylinder 92 is arranged within the interior of a portion of the plunger 82. In an embodiment, a pull knob 94 extends from the first end 95 of the cylinder 92 beyond the adjacent first end 84 of the plunger 82. The pull knob 94 may, but need not be, oriented substantially perpendicular to the handle 86 as shown in the FIGS. Formed at the second end of the cylinder 92 is a first valve V1 movable to form a seal against a corresponding surface 96 of the plunger 82. Another biasing mechanism 98 is positioned between a portion of the plunger 82 and the cylinder 92. The biasing mechanism 98 is operable to bias the cylinder 92 into a default position relative to the plunger 82. In an embodiment, in the default position, the first valve V1 is in sealing engagement with surface 96 of the plunger 82.

Figure 8A:
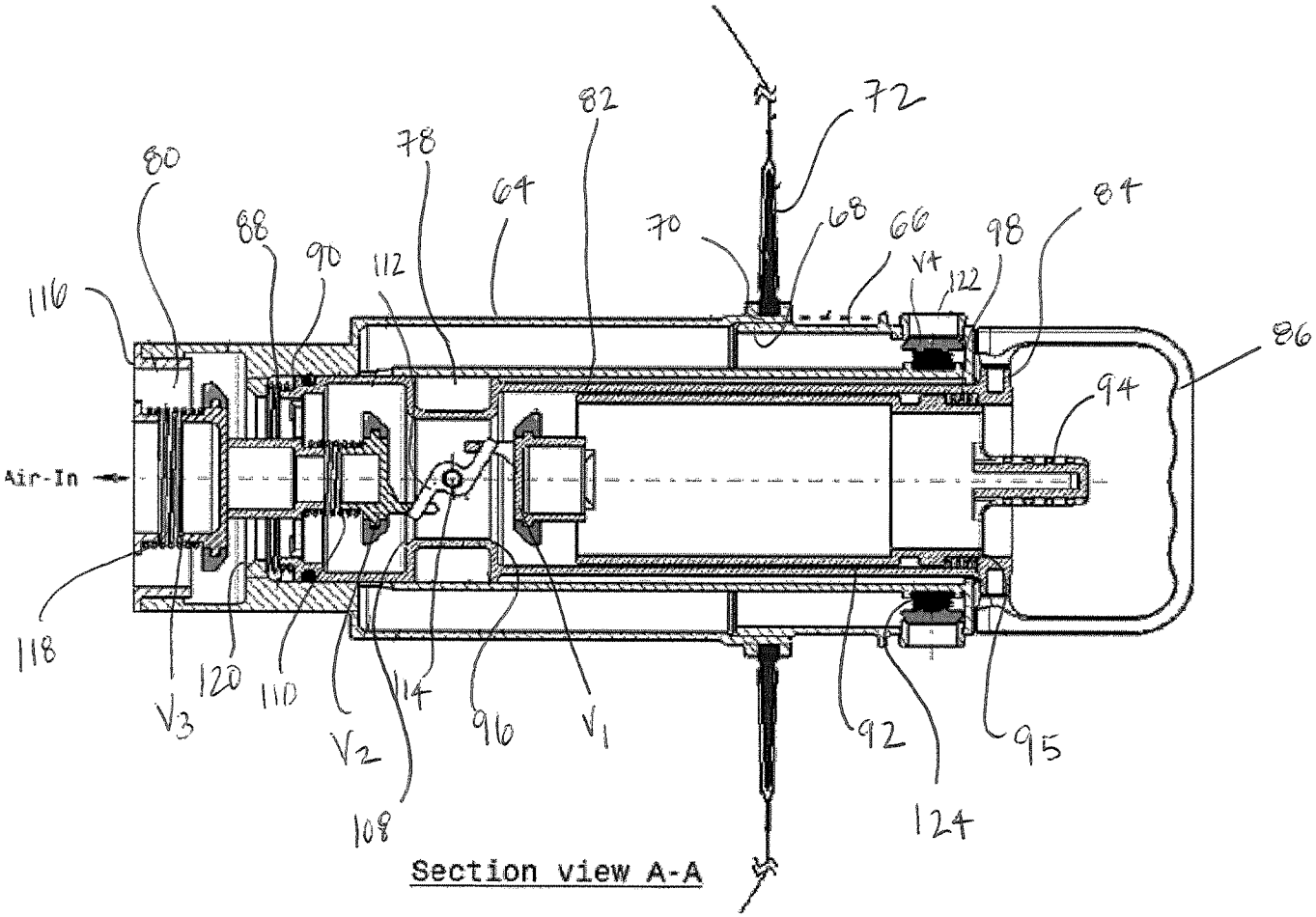
FIG. 8A is a cross-sectional view of the valve assembly of FIG. 8 taken along line A-A according to an embodiment.
Figure 8B:
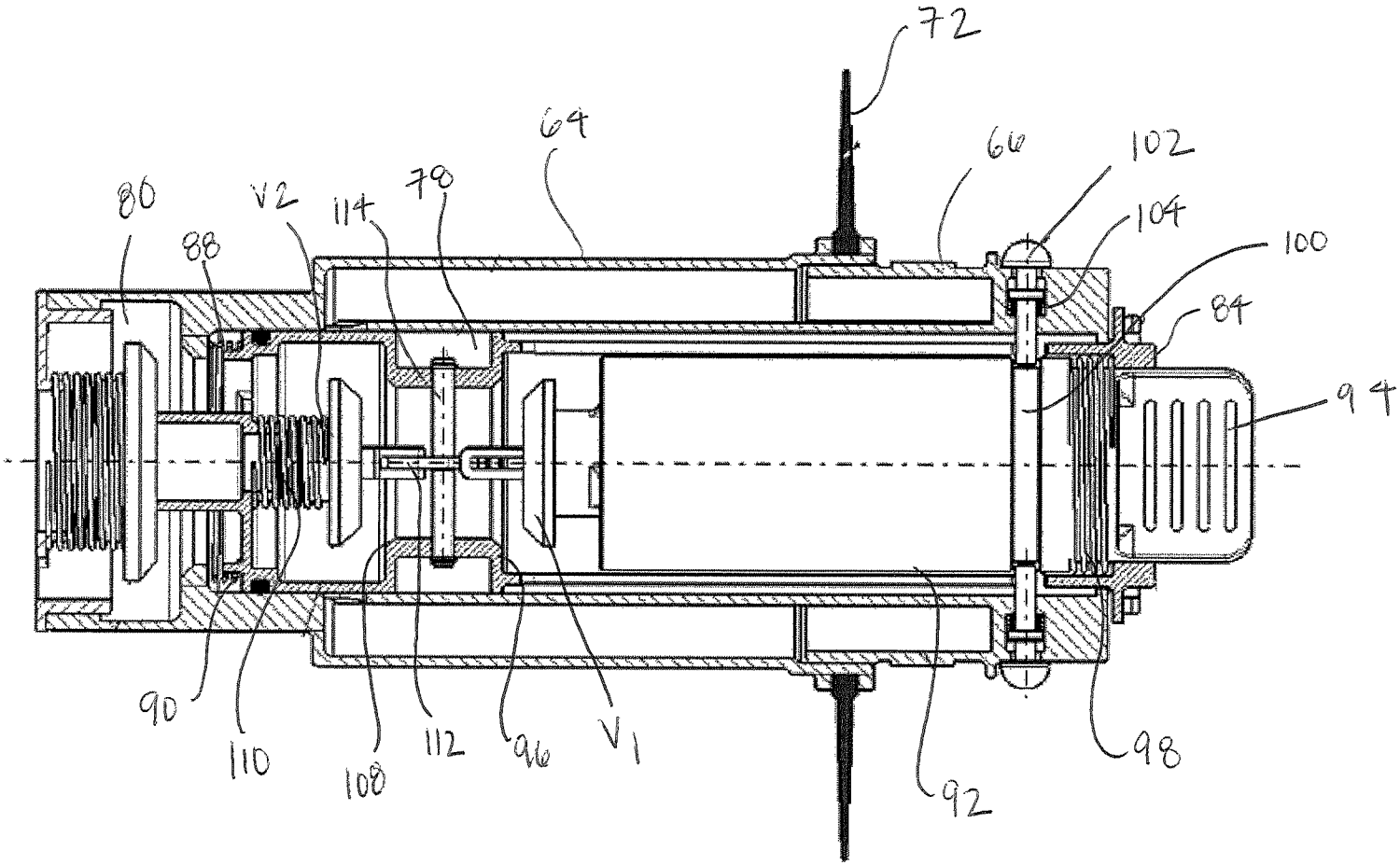
FIG. 8B is a cross-sectional view of the valve assembly of FIG. 8 taken along line B-B according to an embodiment.

A groove, best shown in FIGS. 7 and 8B, is formed about a circumference of the cylinder 92. A trigger pin 102 is movably mounted to the front housing 64 in alignment with the groove 100. When a portion of the trigger pin 102 is received within and engages the groove 100, the trigger pin 102 opposes the biasing force of the biasing mechanism 98 to retain the first valve V1 in a position offset from a corresponding engagement surface 96. A biasing mechanism 104 is coupled to the trigger pin 102 and is configured to move the trigger pin 102 out of engagement with the cylinder 92. Accordingly, upon movement of the trigger pin 102, the cylinder 92 is movable toward surface 96 in response to the biasing force of the biasing mechanism 98.

Figure 4B:
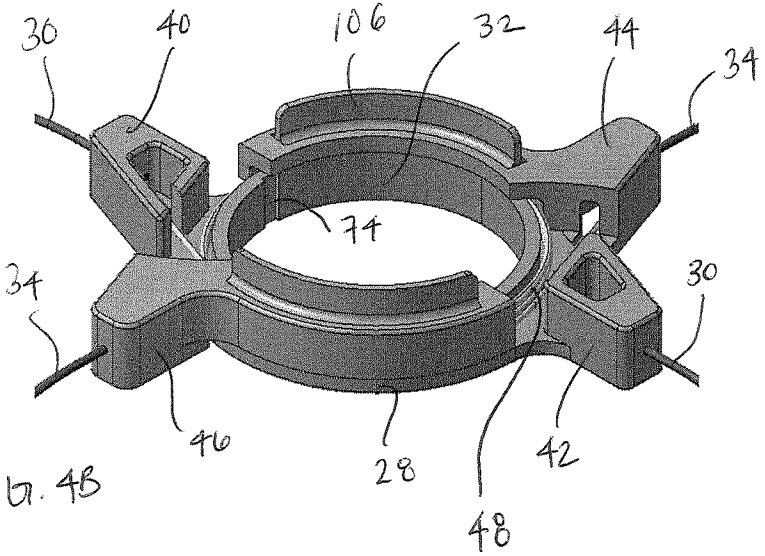

In an embodiment, the second members 32 of the stiffener assembly 22 include a flange 106 extending from a surface thereof (see FIGS. 4A and 4B). When the second member 32 is in the first position, the flange 106 is configured to oppose the biasing force of mechanism 104, thereby restricting movement of the trigger pin 102 from the groove 100. Upon deployment of the stiffener assembly 22, as the second member 32 rotates relative to the housing 64 and the first member 28, the flange 106 rotates out of engagement with the trigger pin 102.

A second valve V2 is positioned within an interior portion of the plunger 82, for example adjacent the second end 90 thereof. The second valve V2 is similarly movable to form a seal against a corresponding surface 108 of the plunger 82. A biasing mechanism 110 extends between the second valve V2 and an interior surface of the plunger 82. The biasing mechanism 110 is configured to bias the second valve V2 to a position where the second valve V2 is sealed against the surface 108 of the plunger 82.

In an embodiment, the first valve V1 and the second valve V2 are operably coupled via a cam mechanism 112 rotatably mounted within the plunger 82 via a pin 114. Accordingly, the first valve V1 and the second valve V2 are configured to move between a sealed position and an unsealed position generally in unison. As a result, application of a force to the cylinder 92 opposing the biasing force of the biasing mechanism 98, such as via the trigger pin 102 for example, may be transmitted to the second valve V2 via the cam mechanism 112. The rotation of the arms of the cam mechanism 112 applies a similar force to the second valve V2 in a direction opposing the biasing mechanism 110 coupled thereto. Upon release of the opposing force, both biasing mechanisms 98, 110 will act on the first and second valves V1, V2 to seal the first and second valves V1, V2.

A third valve V3 is mounted to a second end 116 of the rear housing 64 and is operable to selectively seal the interface between the first chamber 78 and the second chamber 80. A biasing mechanism 118 is operably coupled to the third valve V3 to bias the valve into sealing engagement with an adjacent surface 120, such as an adjacent surface of the housing 64 for example. At least one fourth valve V4 positioned within a channel defined by the housing 62 selectively seals an opening 122 formed in the housing 62. A biasing mechanism 124 associated with the at least one fourth valve V4 is biased into sealing engagement with the housing 62 adjacent the opening 122 to block a flow of air through the chamber and into the first chamber 78.

Figure 9:
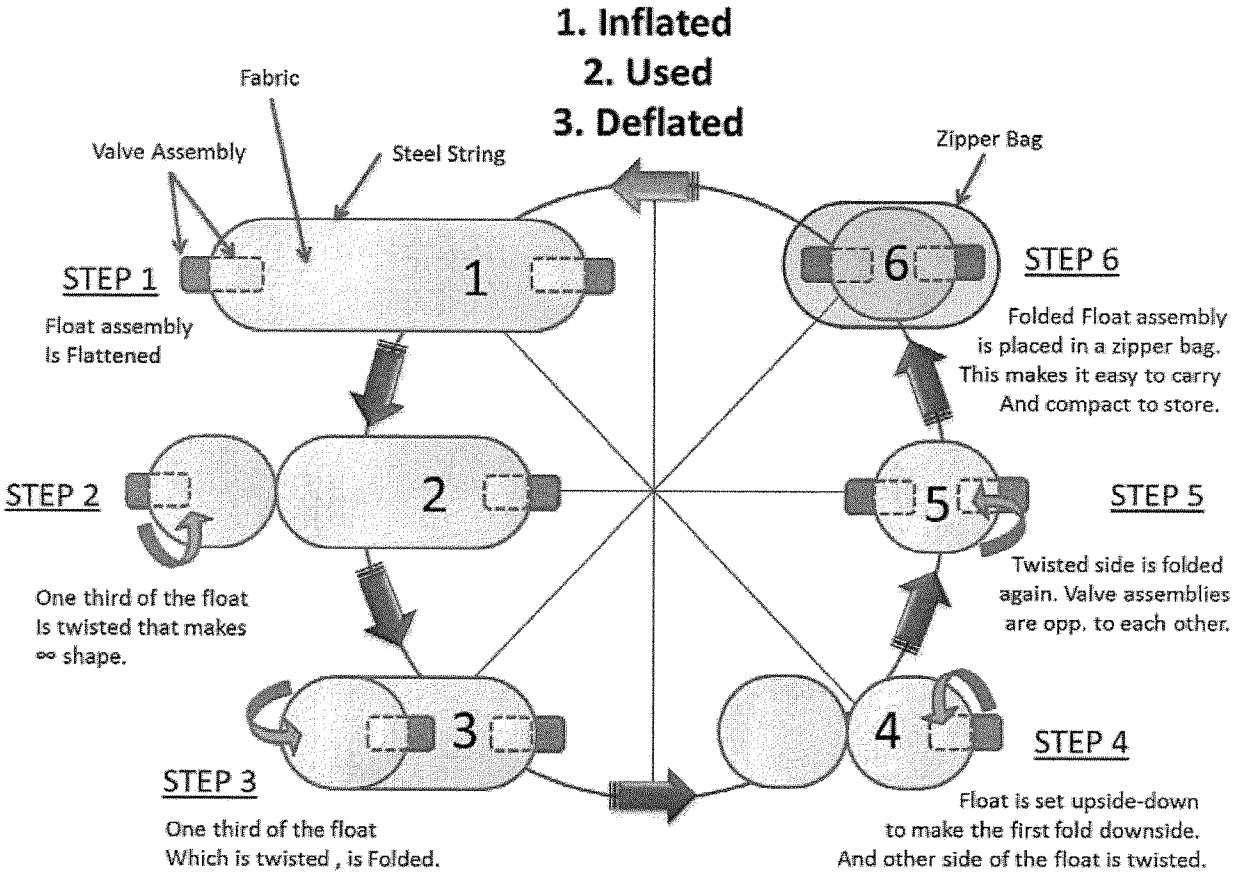
FIG. 9 is a flow diagram illustrating a method of stowing a floatation device according to an embodiment.

With reference now to FIG. 9, the floatation device 20 should be stored within a container to maintain the float in the retracted configuration. To store the flotation device 20, once the air has been removed from the interior cavity and the stiffener assembly 22 has been transformed to the first position where the pairs of first and second structural members 30, 34 are parallel, the float is twisted to form an infinity-like shape. The first portion defined by the twist is then folded over onto the remainder of the float. In an embodiment, the folded over first portion includes about one third of the float. The body of the float is twisted again to define a second portion, for example arranged at an opposite end as the first portion. The second portion is then folded over onto the overlapping first portion and central portion of the float 20. Again, the second portion of the floatation device 20 that is twisted may be about one third of the float. As a result, each portion of the floatation device 20 formed by the various twisting and folding operations is substantially identical. In an embodiment, once both the first and second portions have been folded over, the float 20 has a generally circular or rounded shape, and the valve assemblies 60 extend from opposing sides thereof. In this compact configuration, the floatation device 20 may be positioned within a container, such as a zippered bag for example, to stow and retain the position within this retracted and folded configuration.

When the float is in the retracted position, the first valve V1, second valve V2, and third valve V3 of the valve assemblies are all open and the fourth valve V4 is closed. As a result, fluid is able to flow through the first, second, and third valves into the interior cavity of the floatation device 20. Once the floatation device 20 is removed from the storage container, the spring force of the twisted structural connectors 30, 34 will cause the floatation device 20 not only to untwist, but also to transform from the flattened, retracted configuration to the extended configuration due to the biasing force of the torsion spring of the stiffener assembly 22 and the elastic bands 56 attached to the skin. As the device 20 expands, a partial vacuum is created within the interior of the device 20. Further, the second member 32 of the stiffener assembly 22 moves relative to the housing 62, out of engagement with the trigger pin 102. As a result, the biasing force of the biasing mechanism 104 coupled to the trigger pin 102 moves the trigger pin 102 out of engagement with the groove 100 formed in the cylinder 92, causing the first valve V1, and therefore the second valve V2 to bias into a sealed position. The sealed position of the first and second valves V1 and V2 will block a flow of air or another fluid into and out of from the interior of the device 20. Accordingly, in this extended configuration, the float 20 may be used in water.

Figure 10:
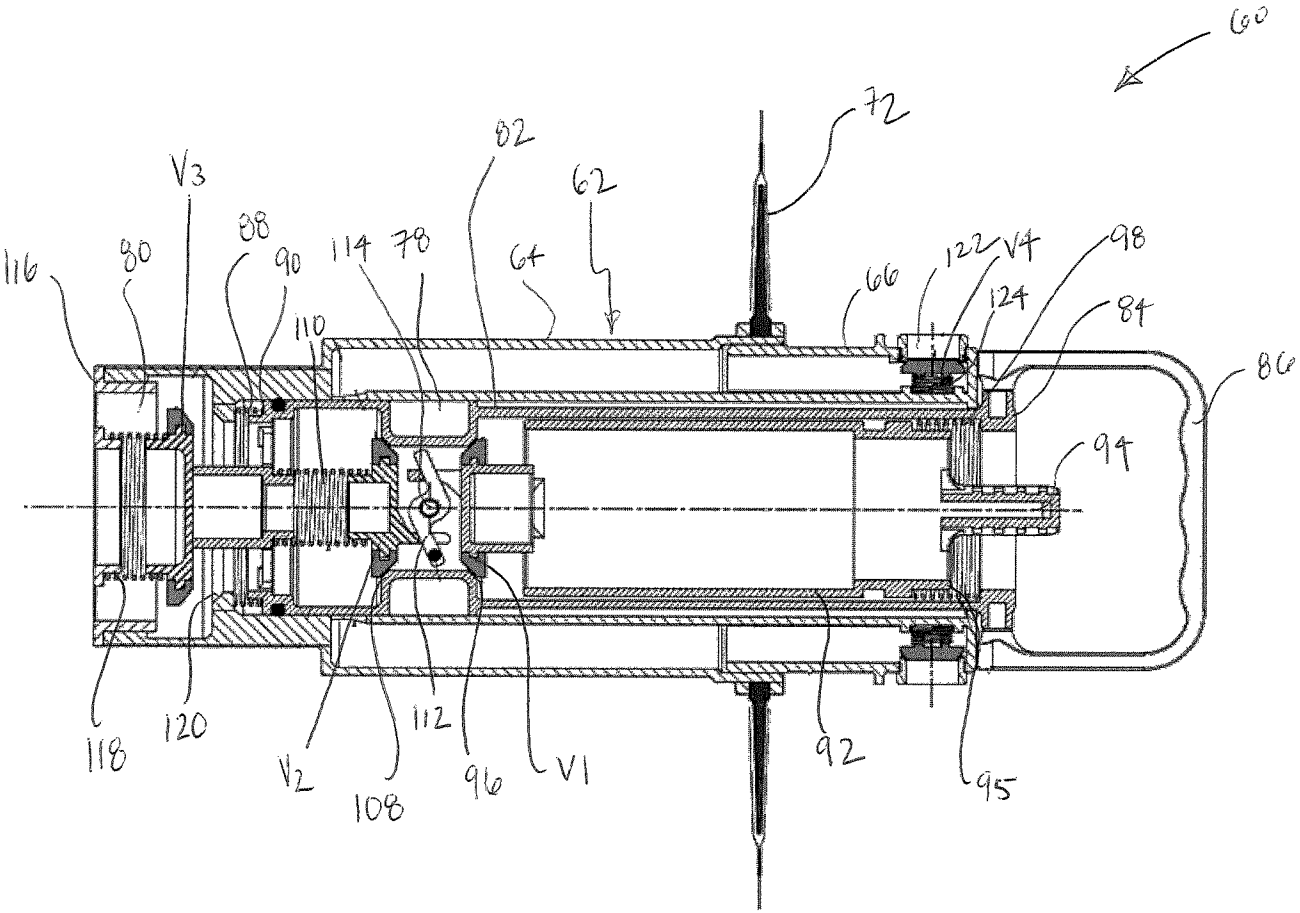
FIG. 10 is a cross-sectional view of the valve assembly of the floatation device when in an extended configuration according to an embodiment.

After being deployed, in the extended position, the floatation device 20 may be manually inflated to a point where the pressure within the interior of the float 20 is equal to the atmospheric pressure. Application of a force to the pull knob 94 will cause the cylinder 92 to translate within the plunger 82 in a direction opposite the force of the biasing mechanism 98. As the first valve V1 moves out of sealing engagement with surface 96 the second valve V2 is similarly translated away from surface 108, due to the rotation of the cam mechanism 112 connected to the first and second valves V1, V2 (see FIG. 8A). With the first and second valves V1, V2 open, air will flow into the interior of the floatation device 20, allowing the pressure within the chamber and the atmospheric pressure to equalize. Accordingly, the first valve V1, second valve V2 and third valve V3 are open during operation of the pull knob 94. Upon release of the pull knob 94, the biasing force of the biasing mechanism 98 will cause the first valve V1, and therefore the second valve V2, to bias back into a sealed position to block a flow or air into or out of the device 20 (see FIG. 10). In addition, the first and second valves V1, V2, prevent water from entering the inside of the floatation device 20 when the pressure of the float is less than or equal to then ambient pressure.

Figure 11:
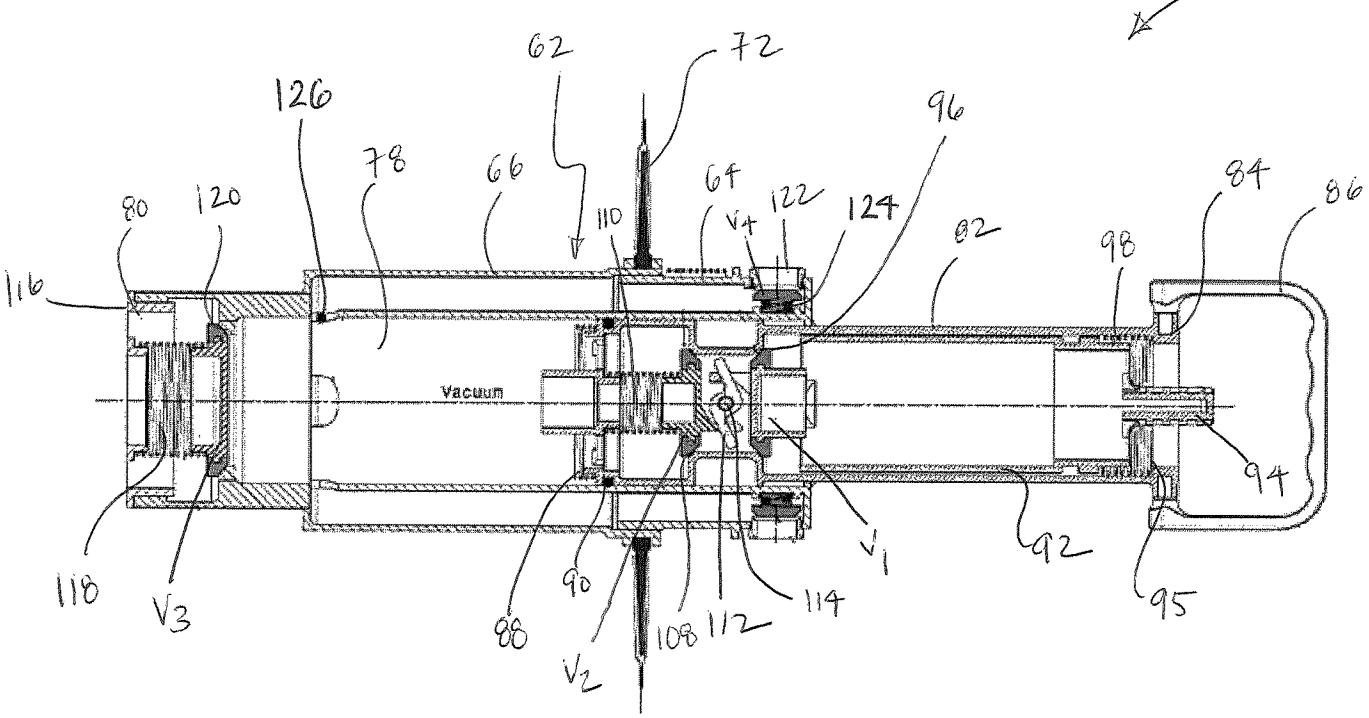
FIG. 11 is a cross-sectional view of the valve assembly of the floatation device during manual inflation using a plunger according to an embodiment.

Alternatively, the floatation device 20 may be manually inflated using the handle 86, as shown in FIG. 11. The handle 86 provides a mechanism for moving the plunger 82 back and forth relative to the housing 62 in a manner similar to a "pump." As the plunger 82 is pulled outwardly relative to the housing 62, a vacuum is created within the first chamber 78. This causes air to rush through the bypass valve V4, and through an air inlet 126 into the first chamber 78. In addition, movement of the plunger 82 relative to the housing 62 causes the third valve V3 to bias into sealing engagement with an adjacent surface. When a force is applied to the handle 86 to reposition the plunger within the first chamber 78, the pressure generated within the first chamber acts on the third valve V3. The pressure causes the third valve V3 to open, and the bypass valve V4 to close, thereby allowing the air within the first chamber 78 to flow into the second chamber 80 and into the interior of the floatation device. This movement of the plunger can be repeated until a desired pressure is achieved within the interior of the float 20.

The plunger 82 is additionally transformable between a locked position and an unlocked position. The plunger 82 is operated to manually inflate the floatation device 20 only when the plunger 82 is in the unlocked position. The plunger 82 may be locked to prevent inadvertent transitioning between the retracted and extended positions. The floatation device 20 will not function properly if the plunger 82 is inadvertently unlocked when the float 20 is deployed because water will enter the interior cavity of the float 20.

Figure 12:
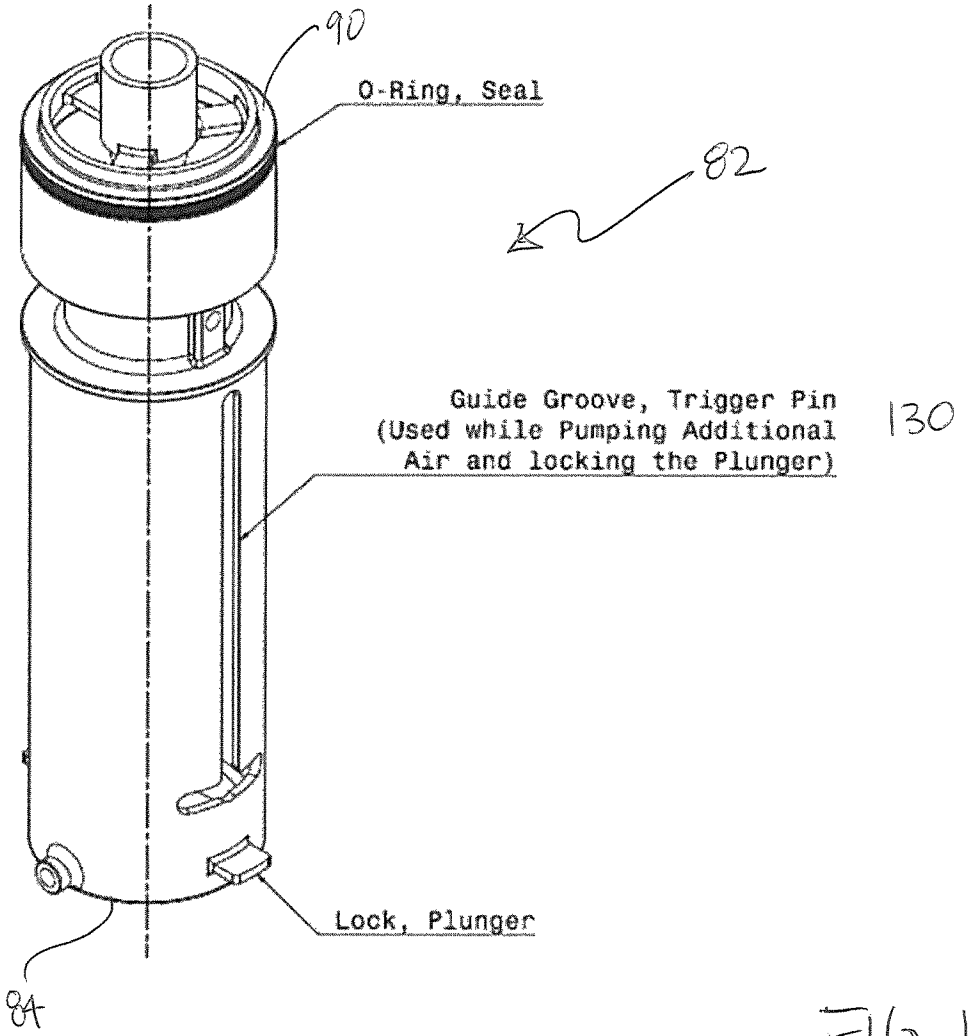
FIG. 12 is a perspective view of a plunger according to an embodiment.

The plunger 82 may be retained in the locked position via the biasing mechanism 88. The biasing mechanism 88 applies a force to the plunger 82 so as to prevent rotation of the plunger 82 due to vibration. In an embodiment, movement of the plunger 82 relative to the housing 62 is also restricted via engagement with the trigger pin 102. With reference to FIG. 12, a guide channel 130 may be formed in a side of the plunger 82. In the illustrated, non-limiting embodiment, the guide channel 130 is generally T-shaped, however, a guide channel having any suitable configuration, such as an L-shape for example is contemplated herein. When the plunger 82 is positioned within the housing 62, the trigger pin 102 is arranged within a portion of the guide channel 130 that restricts translational movement of the plunger 80.

To transition the plunger 82 to an unlocked position for manual inflation, the plunger 82 is rotated about an axis relative to the housing 62. In an embodiment, a force must be applied to the plunger 82 opposing the bias of the biasing mechanism 88 in order to release the plunger 82 from its locked position. In some embodiments, a visual indicator is mounted on the front housing 66. The visual indicator is configured to provide a user with information related to the status of the plunger 82, such as whether the plunger 82 is in a locked or unlocked position for example.

It should be understood that the floatation device 20 disclosed herein may additionally comprise a pressurized container configured to supplement the pressure within interior cavity after the float has been deployed. Further, the pressurized container may be operated in addition to the valve assembly, or in some embodiments, instead of the valve assembly.

The floatation device 20 illustrated and described herein is configured to automatically inflate upon release from a container. Because this inflation occurs in the absence of a pressurized supply of air or gas, the floatation device 20 has a reduced weight and may be continuously reused. Further, the floatation device 20 has improved stability against buckling when at a reduced pressure due to the springs 30, 34 that extend longitudinally relative to the skin 50.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A floatation device comprising:

a body transformable between a retracted configuration and an extended configuration; and a stiffener assembly movable between a first position and a second position, the stiffener assembly being biased into the second position, wherein the stiffener assembly is operably coupled to the body, such that movement of the stiffener assembly between the first position and the second position causes the body to transform between the retracted position and the extended position, the stiffener assembly including:

a pair of first members operably coupled together by a pair of first structural connectors; and a pair of second members operably coupled together by a pair of second structural connectors, each second member being disposed in overlapping arrangement with one of the pair of first members, the second members being rotatable relative to the first members;

wherein during the transformation of the body between the retracted position and the extended position, a partial vacuum is created within the body to inflate the floatation device.

2. The floatation device of claim 1, further comprising a mechanism for manually inflating the body when the body is in the extended configuration.

3. The floatation device of claim 2, wherein the mechanism is operable to inflate the body to a pressure substantially equal to an ambient atmospheric pressure.

4. The floatation device of claim 2, wherein the mechanism is operable to pump air into the body.

5. The floatation device of claim 1, wherein in the first position, the pair of first structural connectors and the pair of second structural connectors are substantially parallel.

6. The floatation device of claim 5, wherein in the second position, the pair of second structural connectors is at an angle relative to the first structural connectors.

7. The floatation device of claim 6, wherein the angle is between about 60 degrees and about 120 degrees.

8. The floatation device of claim 1, wherein the pair of first structural connectors and the pair of second structural connectors are formed from a resilient material.

9. The floatation device of claim 1, wherein the body includes a skin configured to define an interior cavity, the stiffener assembly being operably coupled to the skin; and the floatation device further comprises a valve assembly arranged in fluid communication with the interior cavity, the valve assembly being coupled to the stiffener assembly.

10. The floatation device of claim 9, wherein movement of the stiffener assembly to the second position causes at least one valve of the valve assembly to seal and block a flow into and out of the interior cavity.

11. The floatation device of claim 9, wherein the valve assembly comprises at least a first valve and a second valve operably coupled to one another, the first valve and the second valve being movable to selectively control a flow into and out of the interior cavity.

12. The floatation device of claim 9, wherein a patch is mounted at at least one interface between the skin and the stiffener assembly.

13. A method of inflating a floatation device, comprising:

biasing a stiffener assembly from a first position to a second position such that the floatation device transitions from a retracted position to an extended position, the stiffener assembly including:

a pair of first members operably coupled together by a pair of first structural connectors; and a pair of second members operably coupled together by a pair of second structural connectors, each second member being disposed in overlapping arrangement with one of the pair of first members, the second members being rotatable relative to the first members;

creating a partial vacuum within an interior cavity of the floatation device causing air to be drawn therein; and sealing at least one valve of a valve assembly of the floatation device to block a flow of air into and out of the interior cavity.

14. The method of claim 13, further comprising removing the floatation device from a storage container.

15. The method of claim 13, further comprising manually inflating the floatation device when in the extended configuration.

16. The method of claim 15, wherein manually inflating the floatation device includes opening at least one valve of the valve assembly to allow air to flow into the interior cavity.

17. The method of claim 16, wherein manually inflating the floatation device includes equalizing a pressure within the interior cavity with an ambient atmospheric pressure.

18. The method of claim 15, wherein manually inflating the floatation device includes repeatedly translating a plunger of the valve assembly to form a pumping mechanism.

19. The method of claim 18, wherein translation of the plunger away from the valve assembly creates a vacuum and translation of the plunger towards the valves assembly causes at least one valve of the valve assembly to open and the air within the valve assembly to flow into the interior cavity.

* * * * *